US012275510B2

(12) United States Patent
Owen, III

(10) Patent No.: US 12,275,510 B2
(45) Date of Patent: Apr. 15, 2025

(54) THRUST DEVICE

(71) Applicant: Miller W. Owen, III, Panama City, FL (US)

(72) Inventor: Miller W. Owen, III, Panama City, FL (US)

( * ) Notice: Subject to any disclaimer, the term of this patent is extended or adjusted under 35 U.S.C. 154(b) by 487 days.

(21) Appl. No.: 17/750,752

(22) Filed: May 23, 2022

(65) Prior Publication Data

US 2022/0371712 A1 Nov. 24, 2022

Related U.S. Application Data

(60) Provisional application No. 63/191,527, filed on May 21, 2021.

(51) Int. Cl.
*B63H 11/107* (2006.01)
*B63H 11/04* (2006.01)
*B63H 25/42* (2006.01)

(52) U.S. Cl.
CPC ..... *B63H 11/107* (2013.01); *B63H 11/04* (2013.01); *B63H 25/42* (2013.01)

(58) Field of Classification Search
CPC ..... B63H 11/04; B63H 11/107; B63H 11/11; B63H 11/117; B63H 25/06; B63H 25/42
USPC ..... 440/40, 42
See application file for complete search history.

(56) References Cited

U.S. PATENT DOCUMENTS 3,187,708 A * 6/1965 Fox ..... B63H 11/117 440/46
3,302,605 A * 2/1967 Kuether ..... B63H 11/113 440/46
3,624,737 A * 11/1971 Keller ..... B63H 11/113 60/221
3,680,315 A * 8/1972 Aschauer ..... B63H 11/04 60/221
3,782,320 A * 1/1974 Groves, Jr. ..... B63H 11/11 440/41
3,827,390 A * 8/1974 De Vault ..... B63H 11/11 60/221
5,123,867 A * 6/1992 Broinowski ..... B63H 11/08 440/38
5,460,553 A * 10/1995 Craig ..... B63H 11/04 440/89 R
6,676,462 B2 * 1/2004 Yanagihara ..... B63H 11/11 440/41

* cited by examiner

*Primary Examiner* — Daniel V Venne
(74) *Attorney, Agent, or Firm* — Adrienne Love

(57) ABSTRACT

A device for redirecting the reverse jet stream flow created by a watercraft to provide a lateral thrust. A first and second main body of device is fixed to the deflector nozzle within first and second reverse nozzle outlet channels, respectively. Each main body has a channel disposed therein. Each channel has a bend that fluidly connects an inlet to an outlet. The reverse flow enters the respective inlet in a downward and backward direction with respect to deflector nozzle. The respective inlet and channel of main body bend the reverse flow such that, when the reverse flow exits the outlet, the reverse flow is primarily lateral.

20 Claims, 17 Drawing Sheets

THRUST DEVICE

CROSS-REFERENCES TO RELATED APPLICATIONS

Pursuant to the provisions of 37 C.F.R. § 119(e), this non-provisional application claims the benefit of an earlier-filed provisional patent application. The earlier application was assigned U.S. Ser. No. 63/191,527 and shares one common inventor.

STATEMENT REGARDING FEDERALLY SPONSORED RESEARCH OR DEVELOPMENT

Not Applicable

MICROFICHE APPENDIX

Not Applicable

BACKGROUND OF THE INVENTION

1. Field of the Invention

This invention relates to the field of devices made for propelling watercraft. More specifically, the invention relates to a mechanism for redirecting a portion of the jet stream created by a watercraft.

2. Description of the Related Art

A water-jet driven craft's primary means of steering is achieved by directing the flow of water through the thrust of the water jet propulsion system. Water jet propulsion vessels are popular for recreational watercrafts. A prior art watercraft 30 is illustrated in FIG. 1. These crafts are typically propelled by two or four stroke gasoline engines in connection with an impeller housed in a tubular chamber, the forward end of which draws in the water and the rearward end which expels it to provide thrust via the jet stream 40 in order to propel the craft or vessel. In most instances, a tubular nozzle (deflector nozzle 34) is attached to the discharge end (nozzle 35) which pivots from side to side in sync with the steering control 36 to provide steering capability.

A detailed view of a prior art jet propulsion system is shown in FIG. 2. The pump assembly 28 includes the tubular chamber (impeller housing 27) and an impeller duct (not shown), which draws in the water. The watercraft moves forward by expelling water out of first nozzle outlet 38 of deflector nozzle 34. The deflector nozzle 34 pivots in sync with the steering control 36 (shown in FIG. 1) allowing the forward steering of the watercraft. As shown in FIG. 3, a reverse gate 32 is pivotably attached to deflector nozzle 34. Deflector nozzle 34 has a nozzle outlet 38, a first and second reverse nozzle outlet opening 42, 44 and a first and second reverse nozzle outlet channel 56, 57. When reverse gate 32 is in an open position (as shown in FIGS. 2 and 3) jet stream expels water out of first nozzle outlet 38. When reverse gate 32 is a closed position (as shown in FIG. 5) jet stream is redirected into first and second reverse nozzle outlet openings 42, 44 through channels 56, 57 and out into the body of water. FIGS. 3 and 4 show first and second reverse nozzle outlet openings 42, 44 and first and second reverse nozzle outlet channels 56, 57 (channels run from reverse nozzle outlet openings 42, 44 until the reverse jet stream is expelled out into the body of water). As shown in FIG. 5, in a closed position reverse gate 32 diverts jet stream downward from the waterline approximately 45 degrees. The jet stream exits primarily through first reverse nozzle outlet opening 42 and channel 56 or second reverse nozzle outlet opening 44 and channel 57 dependent on whether the deflector nozzle 34 is rotated toward the starboard side or port side of the boat. The reader will appreciate that the first and second reverse nozzle outlet channels 56, 57 (as shown in FIG. 4) are angled slightly towards the back of the boat to allow the boat to slow, stop and/or drive the boat in reverse. However, the first and second reverse nozzle outlet channels 56, 57 also direct the flow of water slightly outward toward the port or starboard side of the boat, respectively.

Currently, a watercraft has a limited turning radius when driven in reverse. The prior art nozzle shown deflects the water slightly outward and downward to either the port or starboard side of the boat. When the deflector nozzle 34 is pivoted as far to the port side of the vessel as possible, the diverted jet stream is providing approximately 45 degrees of off plane steering to the vessel (as shown in FIG. 16A). The same is true in the opposite direction. Therefore, it is difficult to maneuver in small areas or around obstacles. Additionally, when a watercraft is moving in one direction, it is difficult to efficiently turn in the opposite direction. The bow of the watercraft tends to maintain the drift of the watercraft in the direction in which it is already moving. Therefore, to turn the watercraft, the force acting on the bow must be overpowered.

Prior art steering systems attempted to solve this problem by developing reverse gates that can drastically redirect the jet flow. The directional reverse gates are horizontally situated (independent of the steerable nozzle) and only pivot about the horizontal axis. When the reverse gate is closed, covering the steerable nozzle, the water is drastically redirected in the direction that the steerable nozzle faces.

The prior art systems are not entirely effective. The drastic redirection of the entire water flow causes the boat to lurch to one side or the other. The force of the lateral thrust on the craft can be abrupt and forceful because the entirety of the flow is being redirected to one side or the other. Additionally, because the water flow is forced to the side of the boat that the deflector nozzles faces, the stern travels in the opposite direction of the steering (when in reverse). Thus, the steering is counter intuitive.

What is needed is a device which can increase control of the vessel when traveling in reverse, without sacrificing the ease-of-use which deflector nozzle's reverse configuration provides. The present invention achieves this objective by providing sufficient lateral thrust to steer the craft in a controlled manner, and intuitively do so, much like automobiles and outboard powered craft. It is important to note that most boat operators will have years of automobile driving experience when they first operate a boat. Boat operators will find driving in reverse natural and intuitive with the present invention installed on the craft.

Pursuant to the provisions of 37 C.F.R. § 119(e), this non-provisional application claims the benefit of an earlier-filed provisional patent application. The earlier application was assigned U.S. Ser. No. 63/191,527 and shares one common inventor.

BRIEF SUMMARY OF THE INVENTION

A device and method for redirecting a portion of the reverse flow of a jet stream created by a watercraft to provide a lateral thrust. Device is made up of a first and second main body, each having a channel therein designed to redirect reverse jet stream from a watercraft. First channel fluidly connects a first inlet to a first outlet and the second channel fluidly connects a second inlet to a second outlet. Channels direct flow downward and outward (from center plane of watercraft) when in use.

The reverse flow enters inlet in a downward and backward direction with respect to main body. The inlets and the channel of main body bend the reverse flow such that when the reverse flow exits the outlet the reverse flow is primarily lateral.

The first and second main body of the device are fixed to deflector nozzle within first reverse nozzle outlet channel and second reverse nozzle outlet channel respectively. Each main body is configured to accept a portion of the reverse flow, providing lateral thrust, as the deflector nozzle pivots to one side or the other of the watercraft. As the deflector nozzle pivots the area of either the first or second inlet exposed to the reverse flow increases slowly until the deflector nozzle has reached its maximum turn radius. At the maximum turn radius, the full area of at least one of the inlets is available to redirect reverse flow.

The steps of the present method include providing device having a first and second main body as described herein. Providing a prior art deflector nozzle. Securing first and second main body to deflector nozzle within first and second reverse nozzle outlet channels. Pivoting the deflector nozzle to allow either channel of either main body to accept reverse flow and redirecting reverse jet flow through channel of main body to redirect reverse flow laterally, as described herein.

The reverse flow is typically 45 degrees from the center plane of the watercraft. Therefore, redirection of the reverse flow provides greater angular deflection for a portion of the flow. As the user steers in reverse, the device provides lateral thrust and greater control over steering.

Any use of the term "primarily" shall be defined as "at least over 90% true" or "at least 90% of the amount specified." Any use of the term "slightly less than" shall be defined as "less than 5% of the amount specified." In other words, "slightly less than 50%" shall be defined as "between 45% and 50% of the total area."

REFERENCE NUMERALS IN THE DRAWINGS

Figure 1:
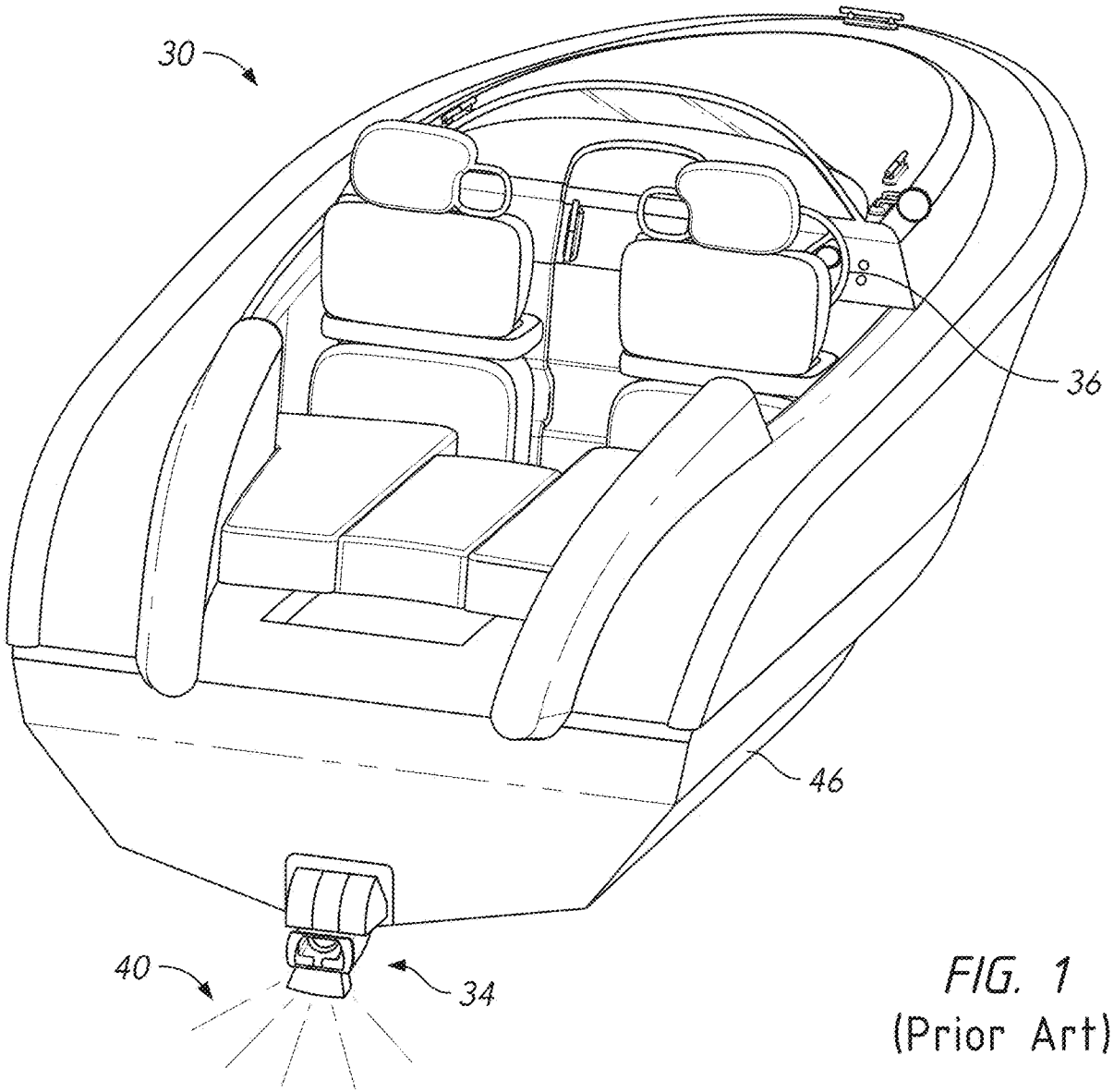
FIG. 1 (Prior Art)
FIG. 1 is a perspective view, showing a prior art watercraft.
Figure 2:
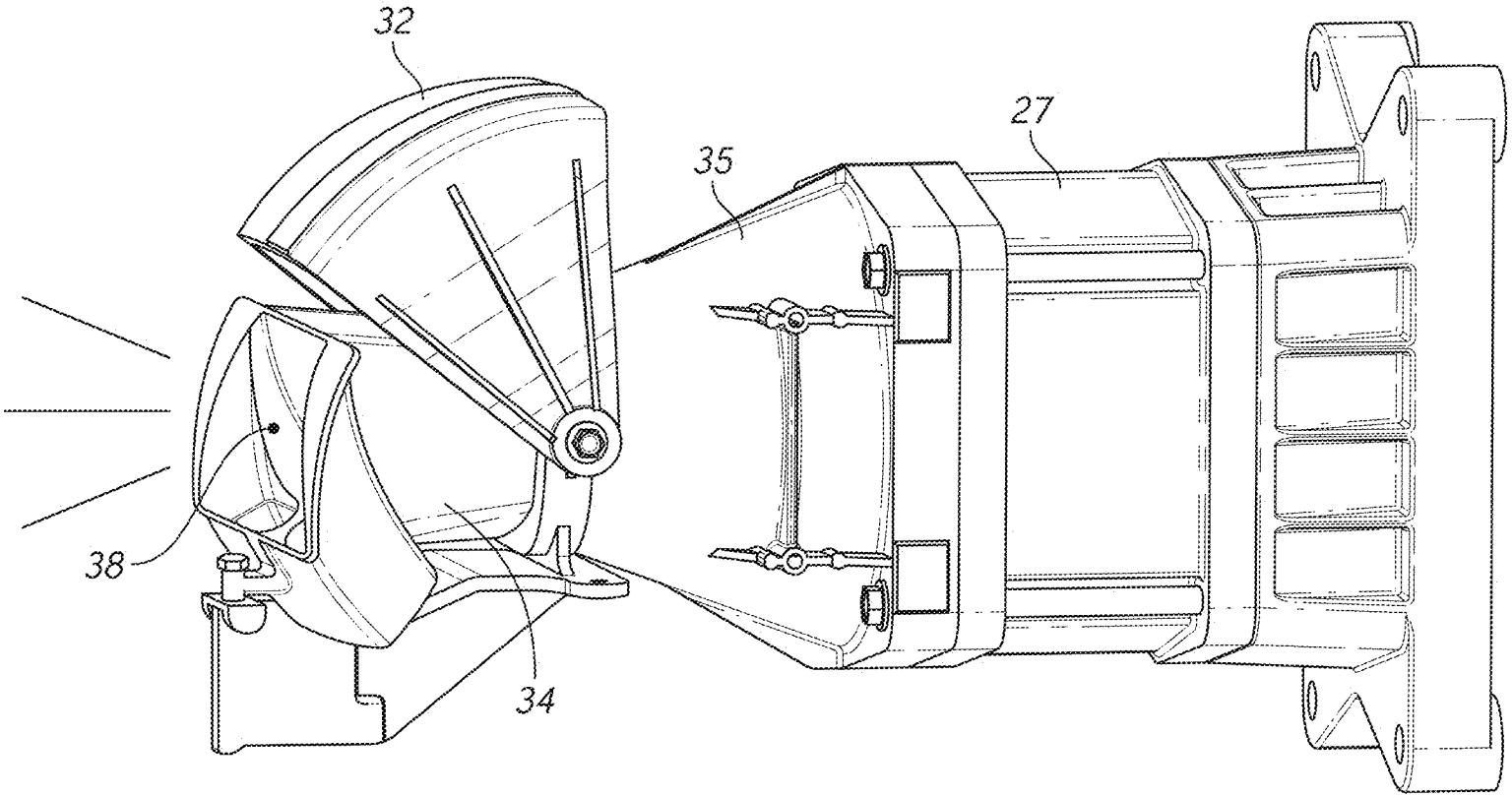
FIG. 2 (Prior Art)
FIG. 2 is a perspective view, showing a prior art jet propulsion system.

10 device
12 first main body
13 second main body
14 first inlet
15 second inlet
16 first channel
17 second channel
18 first outlet
19 second outlet
20 first attachment point
21 second attachment point
22 first bearing
23 second bearing
24 first bolt
25 second bolt
26 center plane
27 impeller housing
28 pump assembly
30 watercraft
32 reverse gate
34 deflector nozzle
35 nozzle
36 steering wheel
38 first nozzle outlet
40 jet stream
41 reverse jet stream
42 first reverse nozzle outlet opening
44 second reverse nozzle outlet opening
46 hull
48 front wall of first main body
49 front wall of second main body
50 side wall of first main body
51 side wall of second main body
52 rear wall of first main body
53 rear wall of second main body
54 bearing wall of first main body
55 bearing wall of second main body
56 first reverse nozzle outlet channel
57 second reverse nozzle outlet channel

DETAILED DESCRIPTION OF THE INVENTION

Figure 6:
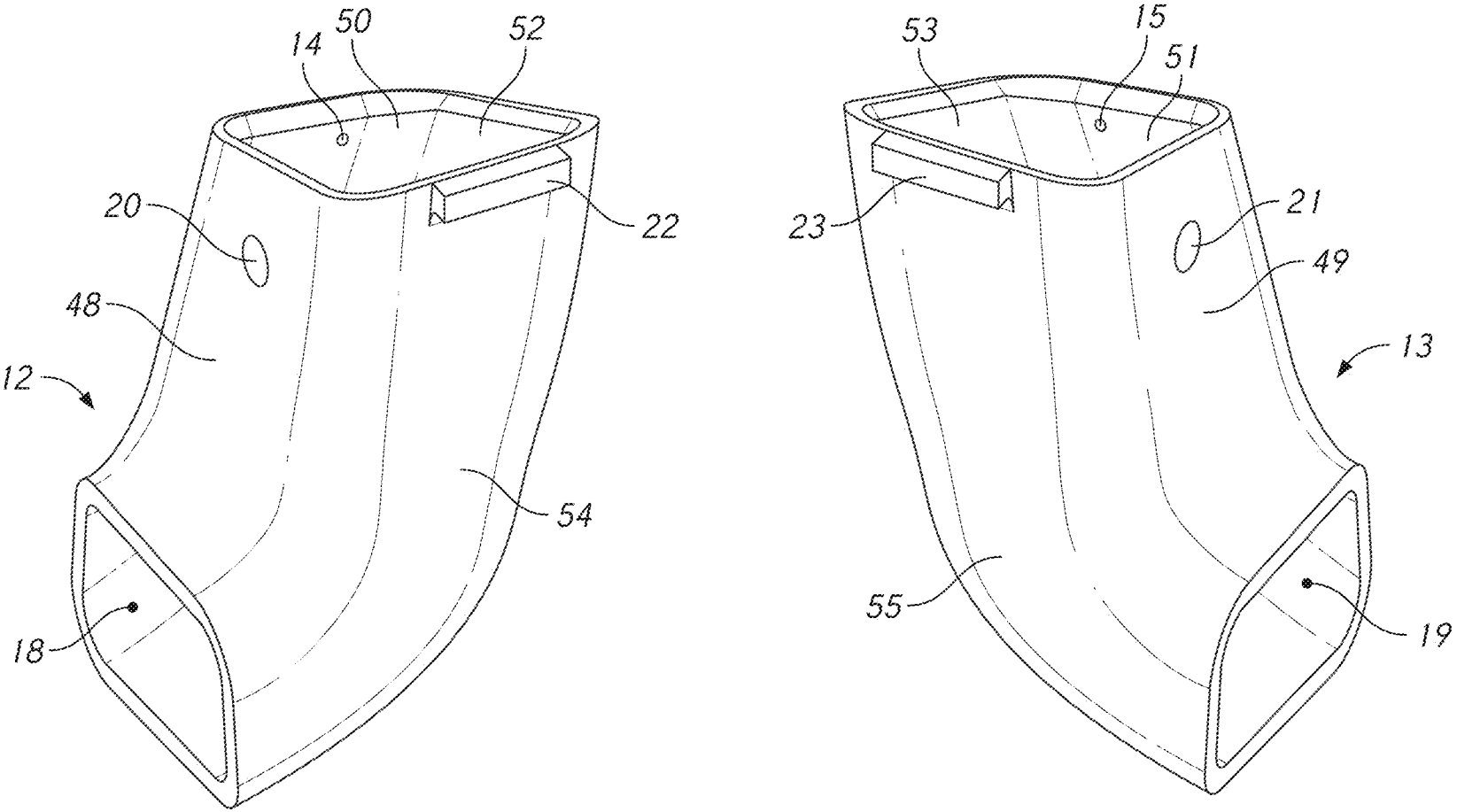
FIG. 6 is a perspective view, showing the present device.

FIG. 6-13 illustrate the present invention in one embodiment and its method of use with deflector nozzle 34. The device 10, including a first main body 12 and second main body 13, redirects a portion of the reverse flow of a jet stream created by a watercraft when connected to a prior art deflector nozzle 34. First main body 12 and second main body 13 of device 10 consist of a channel 16, 17, formed by a series of walls. Series of walls include front wall, rear wall, side wall and bearing wall. First and second channel 16, 17 fluidly connect first and second inlet 14, 15 to first and second outlet 18, 19, as shown in FIG. 6. First and second main body 12, 13 are fixed to deflector nozzle 34 by a strong bolt 24, 25 at attachment point 22, 23, as further described herein. However, the reader will appreciate that any known method of fixing device 10 to nozzle of watercraft can be used.

Figure 7:
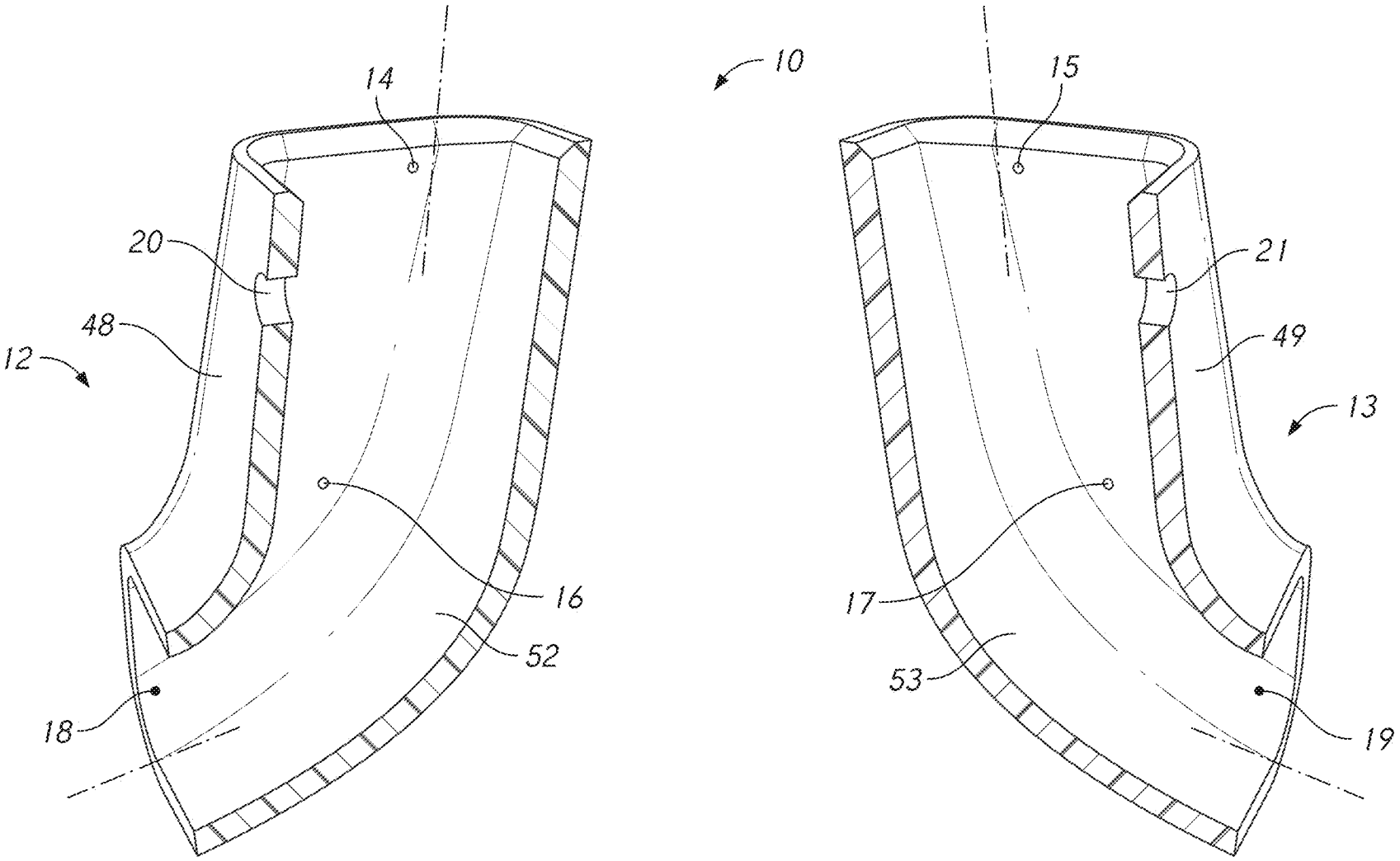
FIG. 7 is a cut-away view, showing a portion of the present device.

A cut-away perspective view with a portion of walls of main body 12, 13 cut away is shown in FIG. 7. Inlets 14, 15 and outlets 18, 19 are visible and are voids that permit entry and exit to channels 19, 21 within main body 12, 14. The inner side of series of walls define channels 19, 21. Channels 19, 21 curve such that channel at inlets 14, 15 (along cross-section of inlets—shown as broken line) is generally perpendicular to channel at outlet 18, 19 (along cross-section of outlet—shown as broken line). The reader will appreciate that the curvature of channels 16, 17 can also form nearly a right angle.

When reverse flow of jet stream is directed towards first main body 12, reverse flow of jet stream enters first inlet 14 and first channel 16 bends reverse flow and directs it towards first outlet 18. First outlet 18 is located on (or formed within) first main body 12. As the reverse flow is expelled through first outlet 18, the flow is primarily lateral. The expulsion of lateral reverse flow through first outlet 18 provides a lateral thrust to watercraft. The same flow direction occurs through second main body 13.

Figure 8:
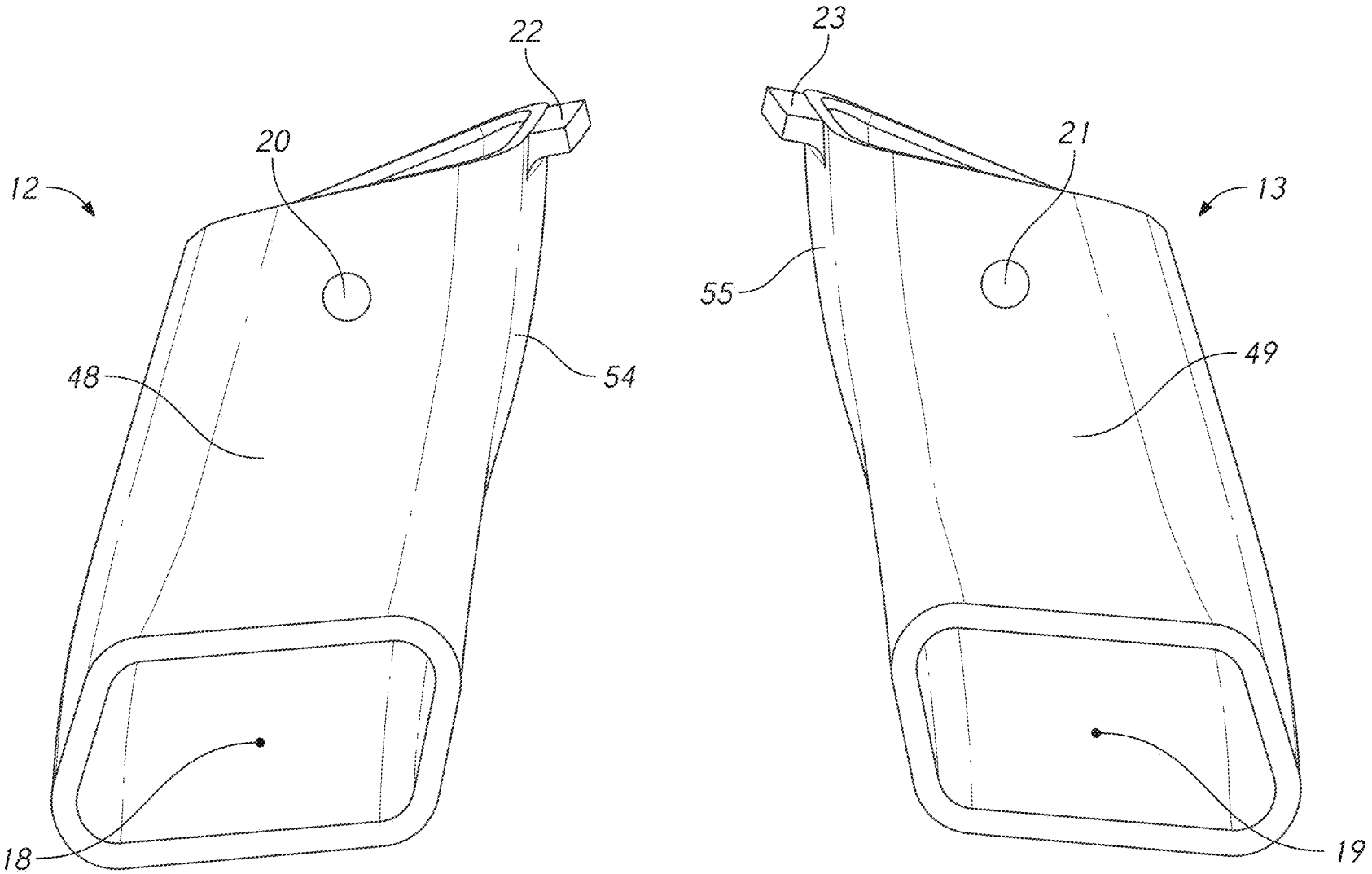
FIG. 8 is a perspective view, showing the present device.

FIG. 8 is a front perspective view of the present device 10. Main body 12, 13 has a series of walls. Generally, main body 12, 13 has a front wall (48, 49), side walls (50, 51), bearing walls (54, 55) and rear wall (52, 53). The reader will appreciate that the terms "front" "rear" "bearing" and "side" are relative to the position first and second main body 12, 13 are oriented in FIG. 8, but have no other meaning with respect to the positioning of device 10 on a watercraft or otherwise. The terms are merely used to describe the structure of the present device 10. Additionally, any number of walls can be included such that the series of walls form the described channels 19, 21. Front and rear walls of main body 12, 13 are angular, as depicted in FIG. 8. On a mid-point at the top of bearing wall 54, 55 of first and second main body 12, 13 first and second bearing 22, 23 are integrated.

Figure 9:
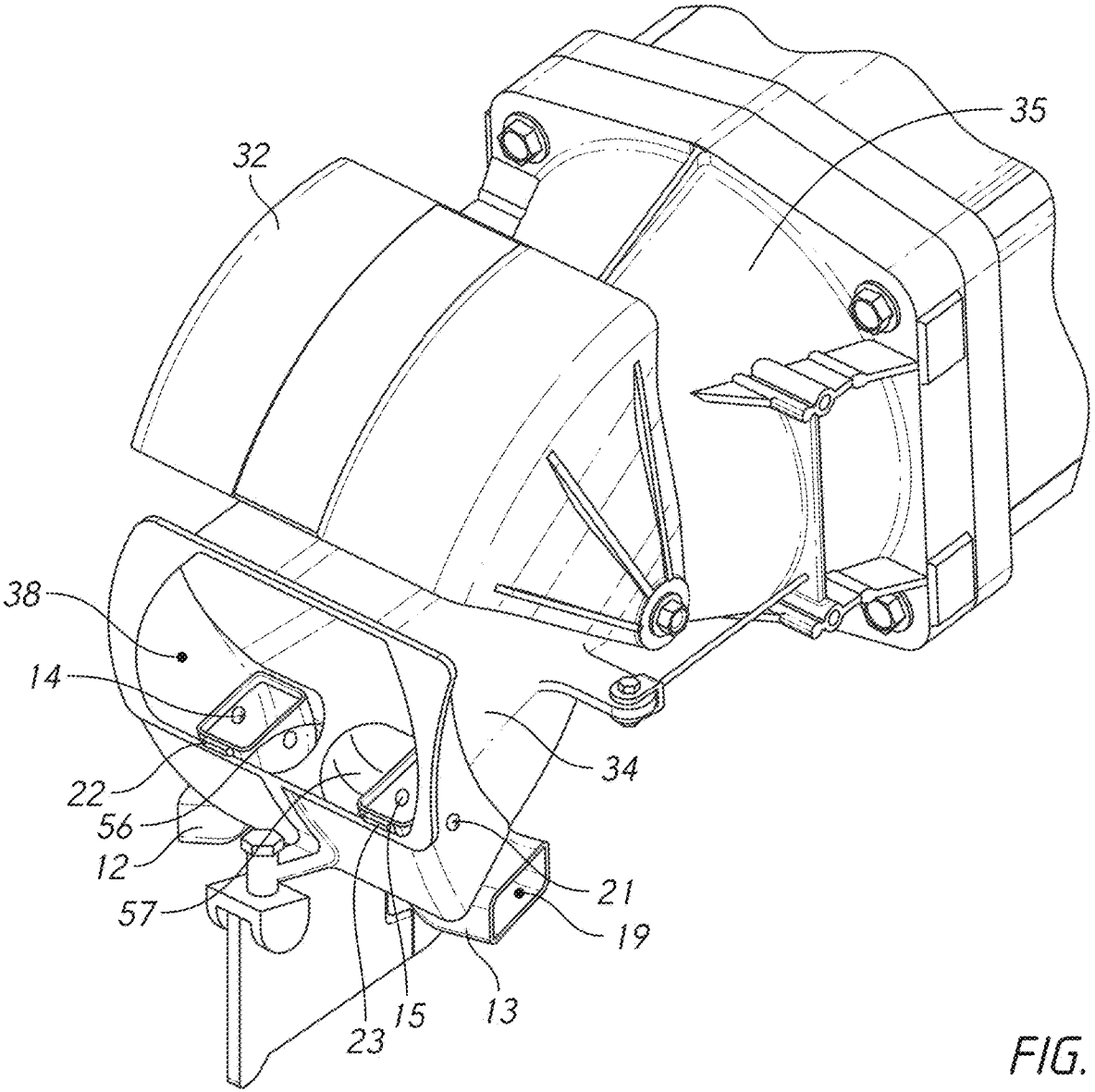
FIG. 9 is a perspective view, showing the present device attached to a deflector nozzle.
Figure 10:
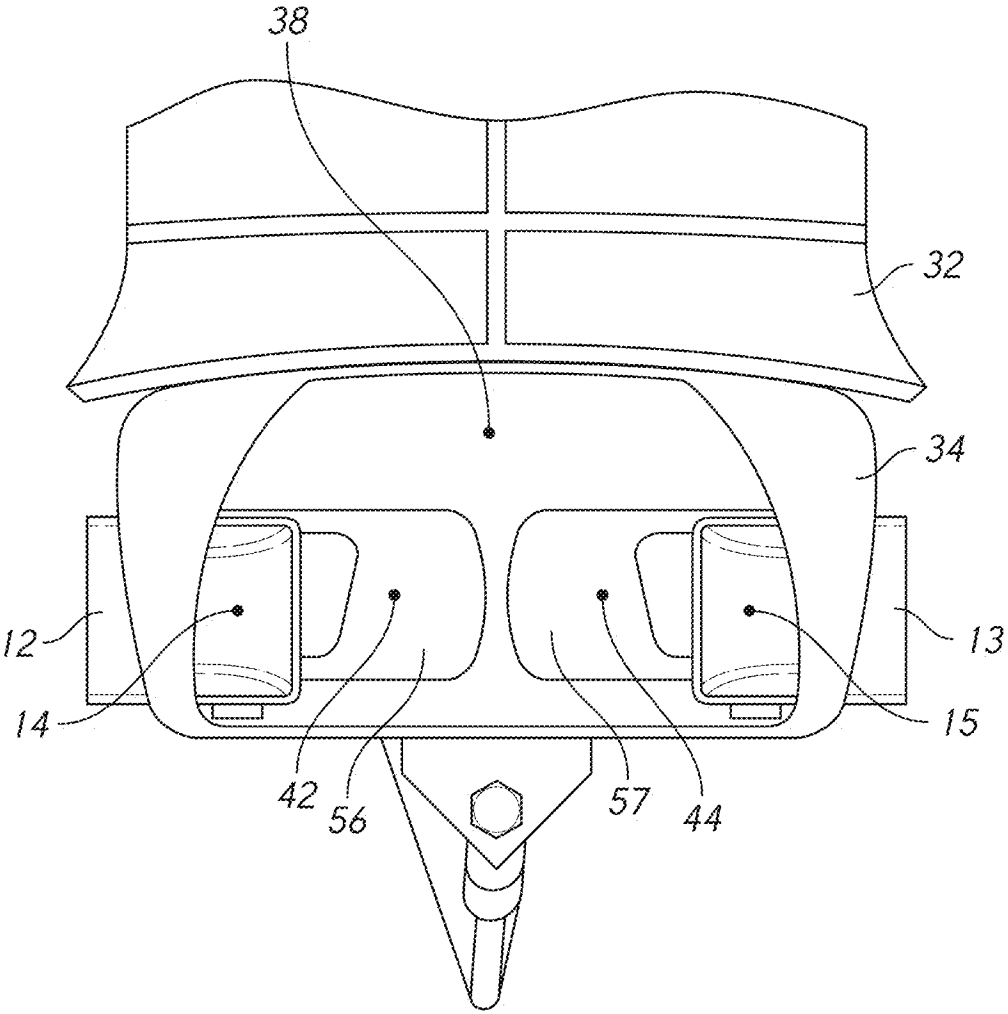
FIG. 10 is a top perspective view, showing the present device attached to a deflector nozzle.
Figure 11:
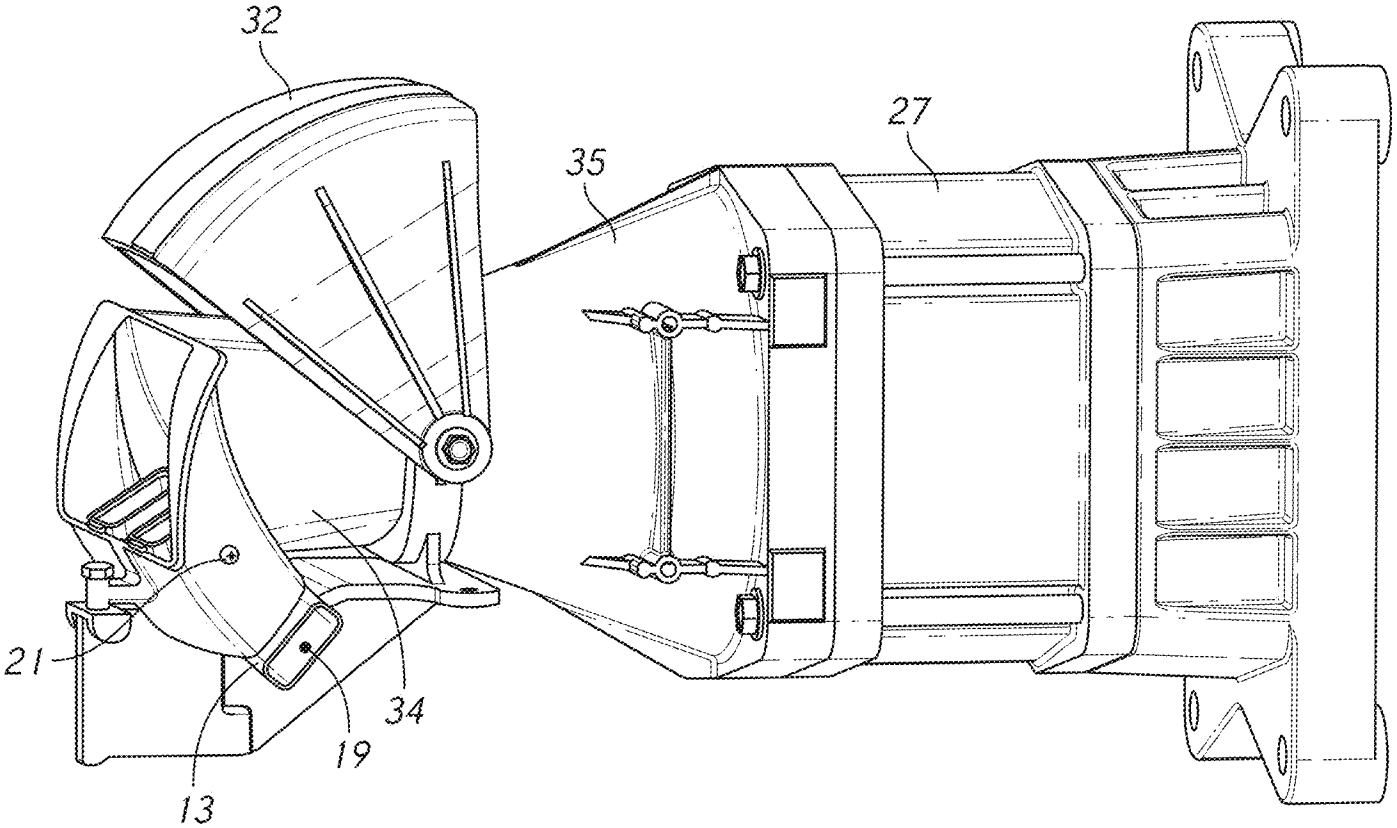
FIG. 11 is a side perspective view, showing the present device attached to a deflector nozzle.

FIG. 9-11 are perspective views showing the present device 10 attached to deflector nozzle 34. Main body 12, 14 includes bearing 22, 23 (on bearing wall 54, 55) and attachment point 20, 21 (on front wall 48, 49) through which a bolt 24, 25 is inserted and thereby securely attached to deflector nozzle 34 within first and second reverse nozzle outlet channels 56, 57. Main body 12, 14 is molded to fit flush against deflector nozzle 34 walls (within first and second reverse nozzle outlet channels 56, 57), as illustrated in FIGS. 9 and 10. Bearing 22, 23 is a raised portion that extends slightly outward from main body 12, 13 and rests on lip of deflector nozzle 34 (at first nozzle outlet 38). Bearing 22, 23 provides additional stability to device 10 by preventing first and second main body 12, 13 from slipping or shifting within reverse nozzle outlet channels 56, 57.

As illustrated in FIG. 9, the reader will appreciate that first and second main body 12, 13 are securely bolted to wall of deflector nozzle 34 at attachment point 21 (attachment point 20—not shown). However, in the alternative, device 10 could be fully integrated with a nozzle, such that nozzle included four reverse channels. The important aspect of the attachment of device 10 to deflector nozzle 34 is that inlets 14, 15 are positioned such that inlets 16, 17 accept a portion of jet stream from deflector nozzle 34, when deflector nozzle 34 is in a specific rotational position, as further described below.

Figure 12:
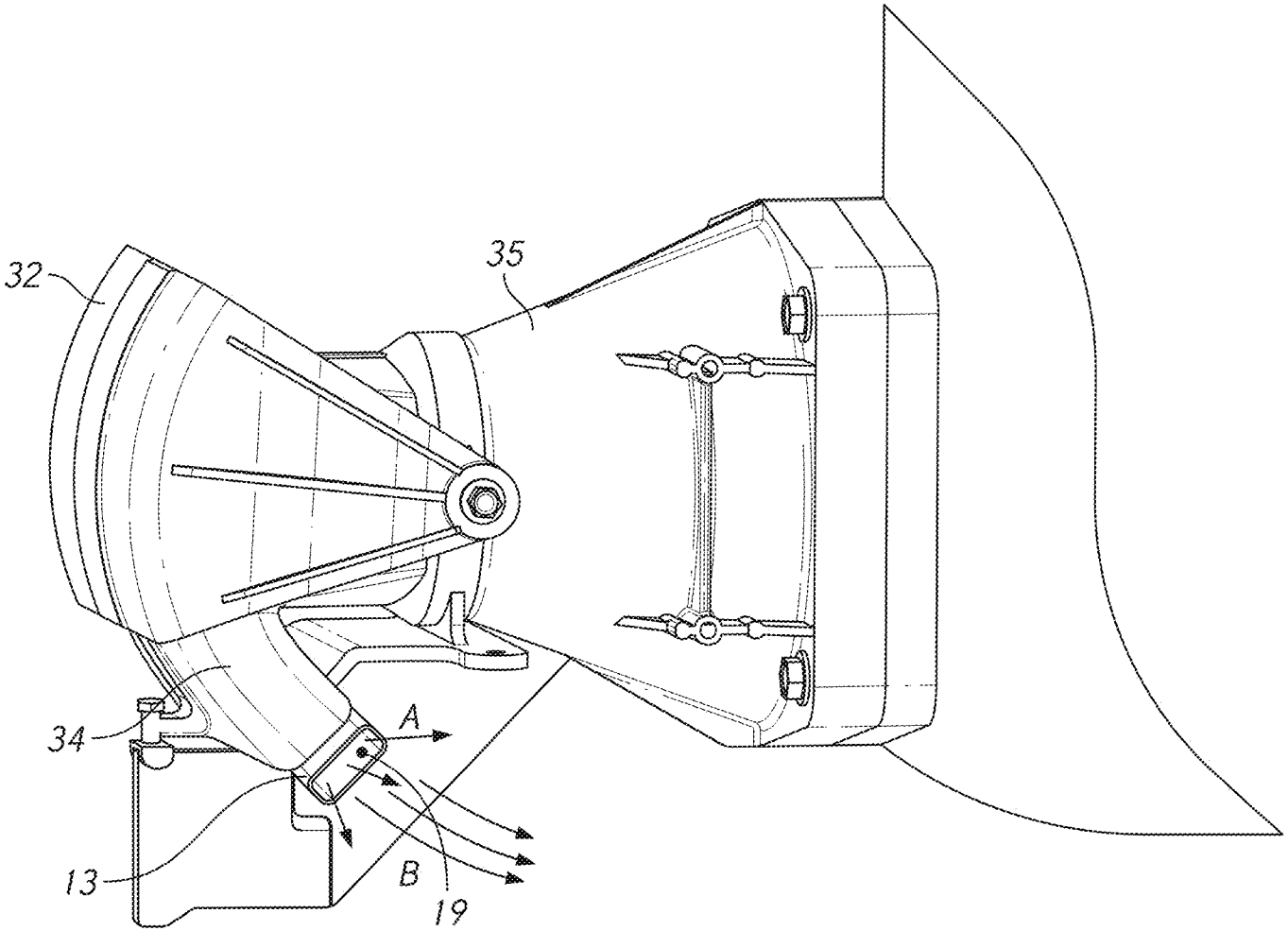
FIG. 12 is a perspective view, showing the flow of reverse jet stream traveling through present device attached to a deflector nozzle.
Figure 15:
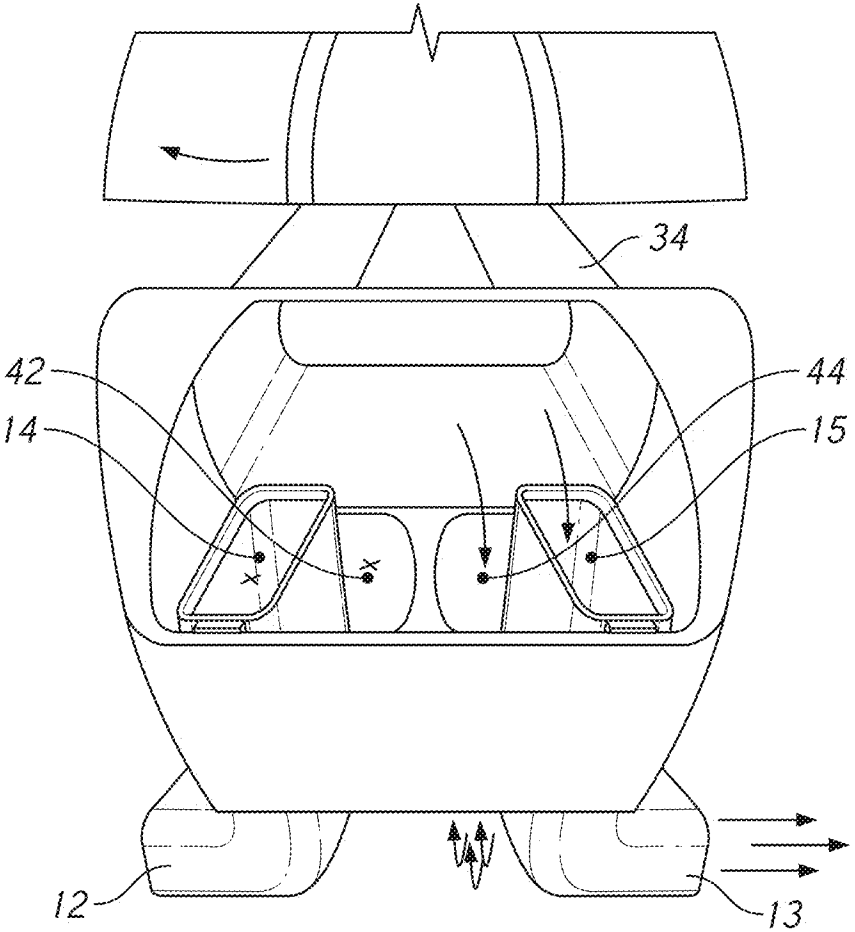
FIG. 15 is a perspective view, showing the present device and flow of water using the present method.

As illustrated in FIGS. 10 and 11, first and second main body 12, 13 pass through first and second reverse nozzle outlet channels 56, 57 and extend outward away from the horizontal axis of deflector nozzle 34, nozzle 35 and impeller housing 27. As shown in FIG. 10, inlets 16, 17 occupy slightly less than 50% of first and second reverse nozzle outlet openings 42, 44. This effectively divides first and second reverse nozzle outlet openings 42, 44 into two channels, respectively (first and second reverse nozzle outlet channels 56, 57 and first and second channel 16, 17 of first and second main body 12, 13). First and second main body 12, 13 would not accept flow when reverse gate 32, as shown, is in a raised position. However, when reverse gate 32 is lowered into the closed position, as shown in FIG. 12, reverse jet stream flow is activated. As illustrated, second outlet 19 expels water nearly perpendicularly away from the horizontal axis of deflector nozzle 34, as shown by arrows A, when rotated hard to port side. The reader will appreciate that arrows B is illustrating the flow from second reverse nozzle outlet opening 44 (as shown in FIG. 15). This flow is traveling downward into the water at an approximately 45-degree angle from the horizontal axis of deflector nozzle 34.

Figure 13:
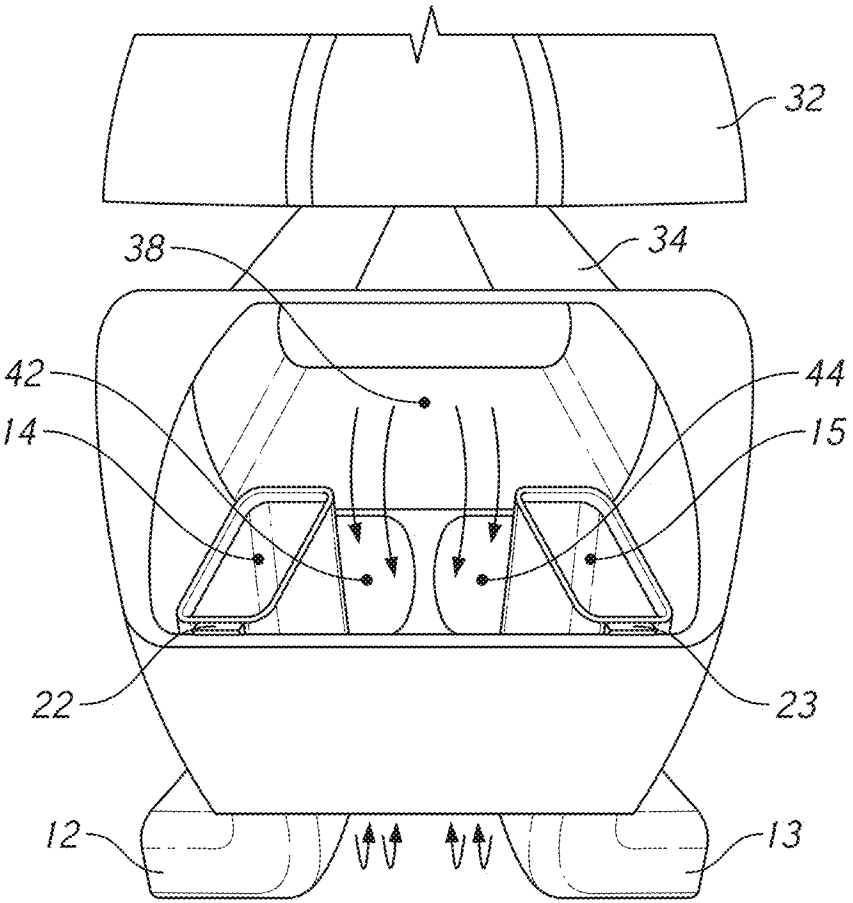
FIG. 13 is a perspective view, showing the present device attached to a deflector nozzle.
Figure 14:
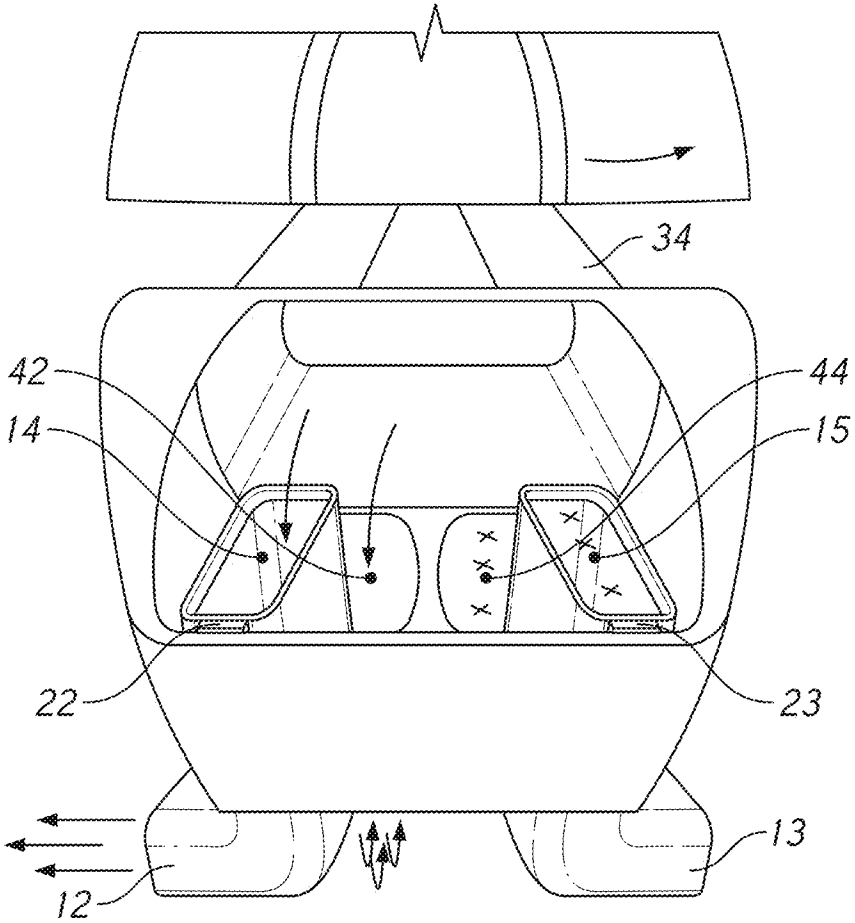
FIG. 14 is a perspective view, showing the present device and flow of water using the present method.

FIGS. 13-15 shown device in position within deflector nozzle 34. For purposes of illustration reverse gate 32 is shown in a raised position. Again, when reverse gate 32 is lowered into the closed position (shown in FIG. 12) the reverse jet stream flow (and present device 10) is activated. When deflector nozzle 34 is square to the watercraft (dead center), the reverse flow is not significantly redirected by device 10 (first and second main body 12, 13). Reverse flow primarily passes through first and second reverse nozzle outlet openings 42, 44 (as seen in FIG. 13). As described in the prior art, reverse flow is redirected approximately 45 degrees off plane and downward. Thus, when nozzle is dead center, reverse flow is not significantly redirected causing unwanted lateral thrust.

However, as shown in FIG. 14, when deflector nozzle 34 is fully rotated toward the starboard side of the watercraft (arrow at top of figure), reverse flow (depicted by multiple arrows) is primarily directed through first reverse nozzle outlet opening 42 and first inlet 14. In this position first inlet 14 (and therefore first channel 16) redirects approximately, but not limited to, one-half of reverse jet stream when in operation. Reverse flow enters first inlet 14 in a downward and backward direction with respect to the position of deflector nozzle 34—in other words, the jet stream contacts reverse gate 32 and is directed downward and backward therefrom. As reverse flow enters first inlet 14, first channel 16 bends reverse flow and directs it towards first outlet 18. As the reverse flow is expelled through first outlet 18, the flow is primarily lateral. The expulsion of lateral reverse flow through first outlet 18 creates a lateral thrust that provides more control over steering while operating the watercraft in reverse. It is important to note that as deflector nozzle 34 rotates, the area of first inlet 14 accepting reverse flow increases or decreases respectively. Thus, lateral thrust slowly increases proportionately to the amount of water being directed into inlet 14. The operation is the same when the deflector nozzle 34 rotates toward the port side of the watercraft, except that reverse flow is now primarily directed through second reverse nozzle outlet opening 44 and second inlet 15. Second inlet 15 redirects reverse flow as opposed to first inlet 14, as shown in FIG. 15. When in operation, the driver enjoys a precise level of control while in reverse. By varying the degree of rotation of the steering wheel the lateral thrust provided can be increased or decreased, thereby providing exceptional control input and confidence for the driver.

Figure 3:
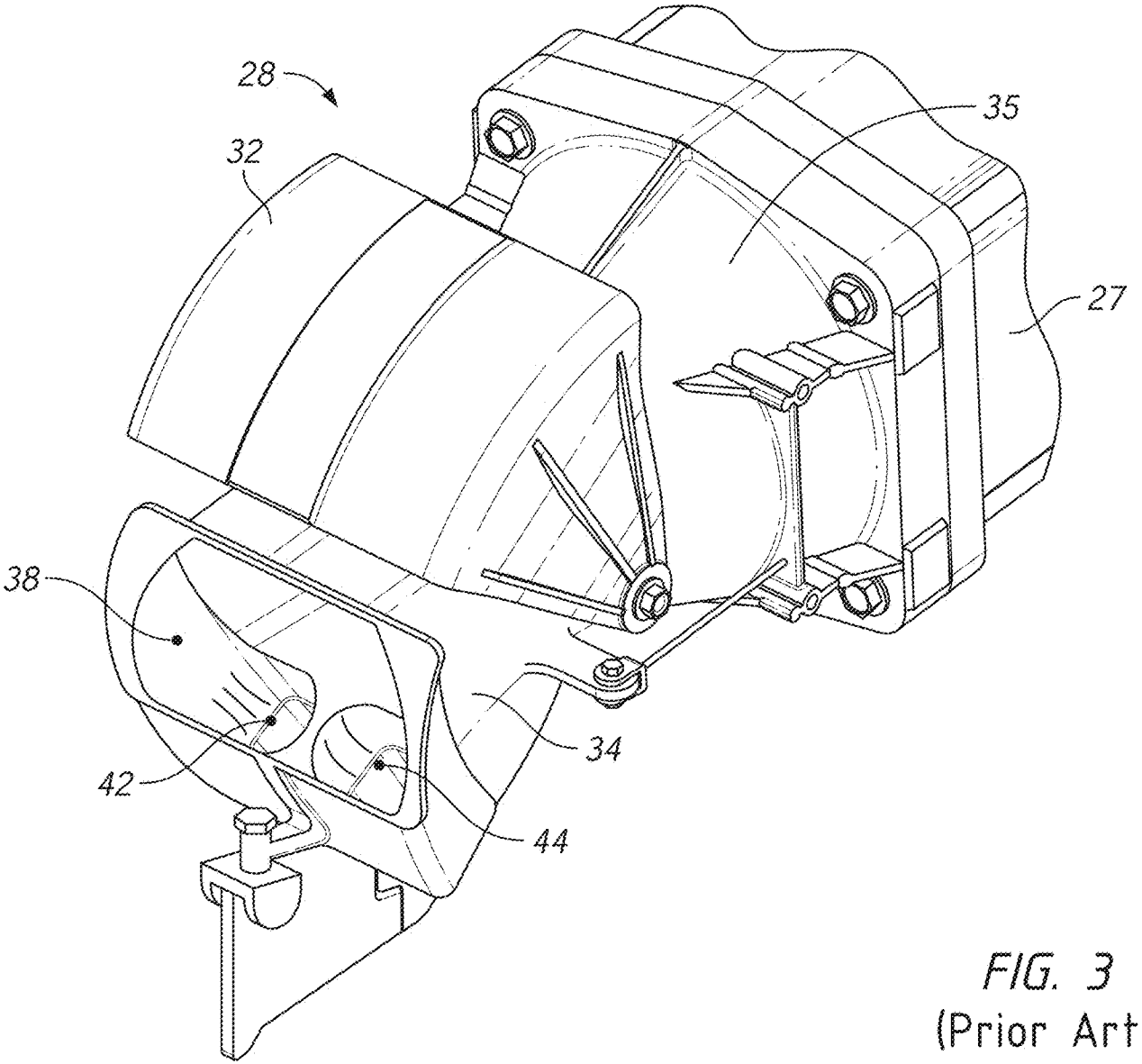
FIG. 3 (Prior Art)
FIG. 3 is a perspective view, showing a prior art deflector nozzle having a reverse gate.
Figure 4:
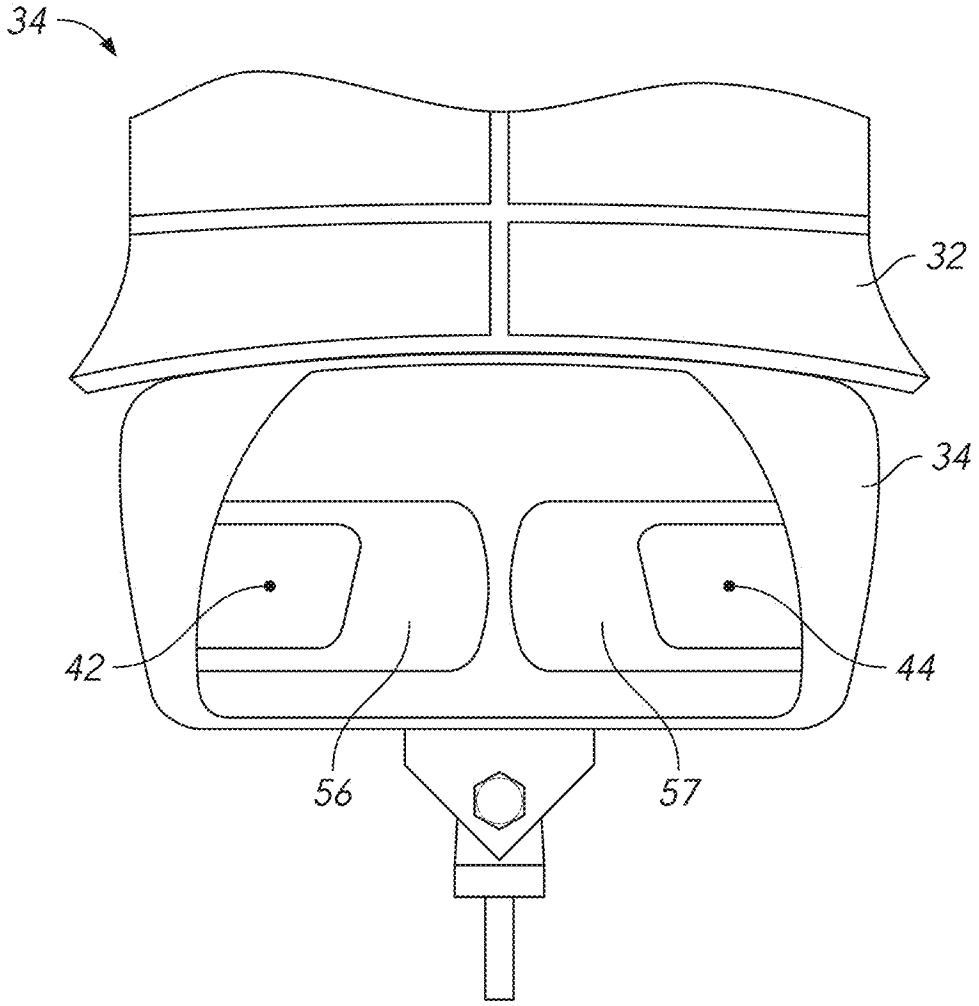
FIG. 4 (Prior Art)
FIG. 4 is a perspective view, showing a prior art deflector nozzle.
Figure 5:
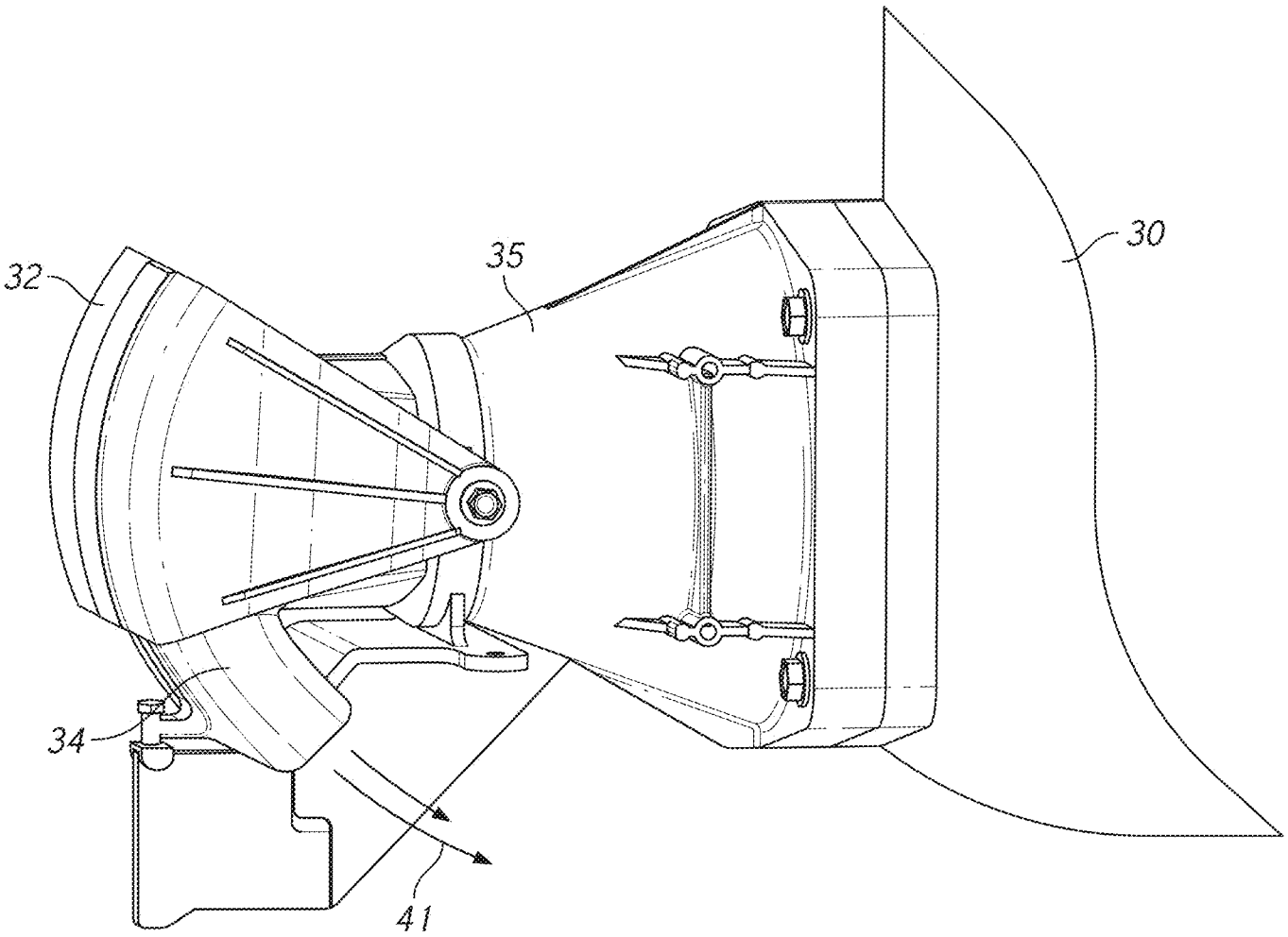
FIG. 5 (Prior Art)
FIG. 5 is a perspective view, showing a prior art deflector nozzle in reverse.
Figure 16C:
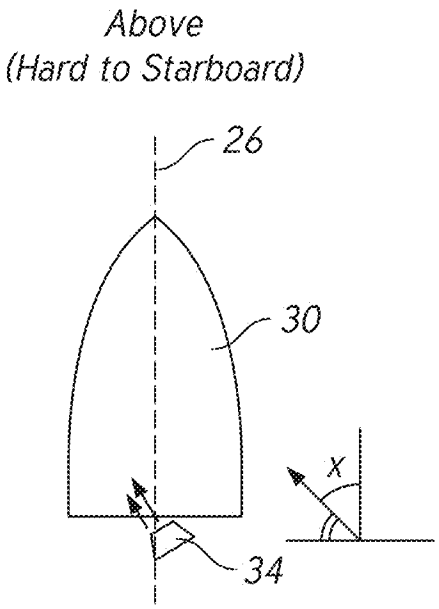
FIG. 16C (Prior Art)
FIGS. 16A, 16B and 16C is a schematic view, showing a simplified depiction of reverse flow on a prior art watercraft.
Figure 16B:
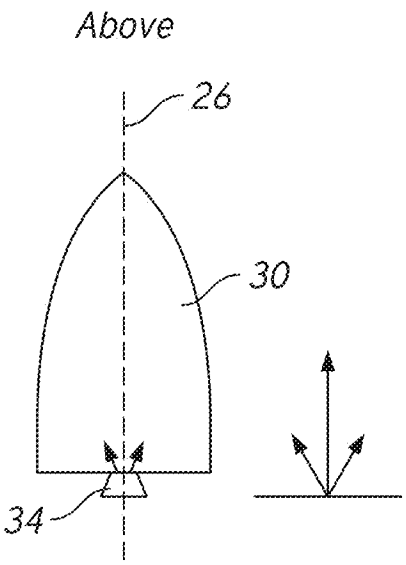
FIG. 16B (Prior Art)
Figure 16A:
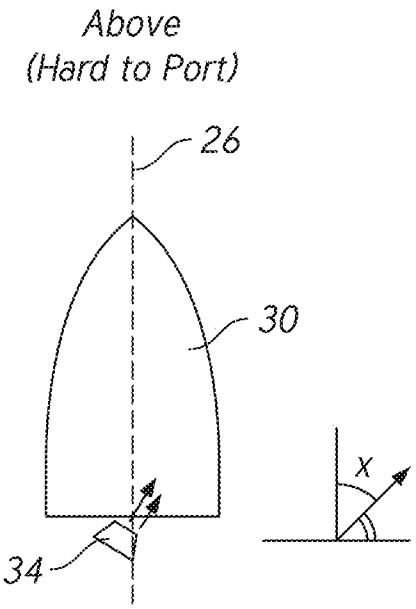
FIG. 16A (Prior Art)

FIGS. 16A, 16B and 16C show prior art schematic views of jet stream redirection while in reverse, with a single engine. Deflector nozzle 34 in FIG. 16A is rotated fully toward the port side of the watercraft 30. When the reverse gate (shown in FIG. 1) is in a closed position, the jet stream (shown with arrows) is angularly displaced from the center plane 26 of watercraft 30 by approximately 45 degrees (shown as angle x to the side of depiction of watercraft). Likewise, in FIG. 16C, where deflector nozzle 34 is rotated fully toward the starboard side of the watercraft 30, the jet stream (shown with arrows) is angularly displaced from the center plane 26 by approximately 45 degrees. Although not shown, the jet stream is also angular displaced downward from the plane of the water by approximately 45 degrees (this is illustrated in FIG. 5). FIG. 16B illustrates the deflector nozzle 34 straight on (no rotation). When in this position, the prior art directs the jet stream out of first and second reverse nozzle outlet channels (56, 57) (as shown in FIGS. 3 and 4, for example). The first and second reverse nozzle outlet channels (56, 57) direct the jet stream slightly off center. However, this results in a net force acting on the watercraft 30 directly rearward. In other words, the force is, as depicted, slowing the watercraft 30 by directing water directly toward the front of the watercraft 30.

Figure 17A:
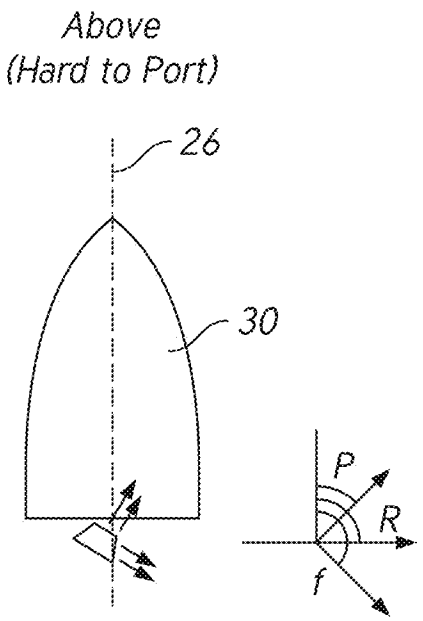
FIGS. 17A, 17B and 17C are schematic views, showing simplified depictions of reverse flow on a watercraft with present device attached thereto.
Figure 17B:
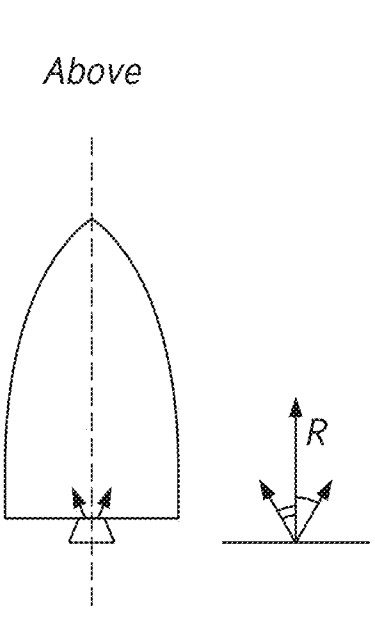
Figure 17C:
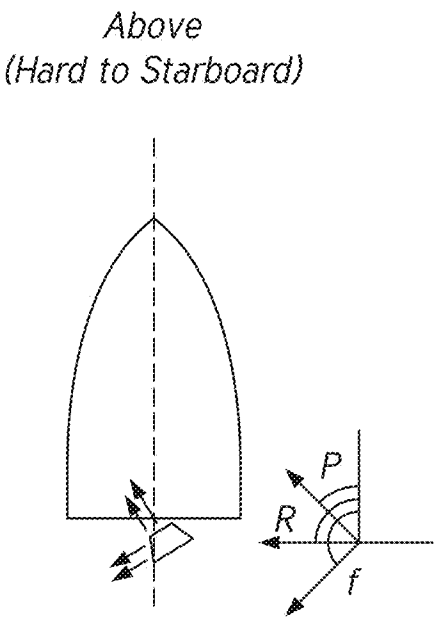

FIGS. 17A, 17B and 17C are schematic views of the jet stream redirection with the present device employed. The three views correspond to FIGS. 15, 13 and 14, respectively. FIG. 17A illustrates the jet stream redirection while in reverse with the deflector nozzle 34 rotated completely toward the port side of watercraft 30. In this position, the jet stream is divided approximately in half—with approximately 50% exiting through second nozzle outlet opening 44 and approximately 50% exiting through second inlet 15 of device (as shown in FIG. 15). The portion of the reverse flow that is accepted into inlet is redirected through channel and expelled through outlet 19. The letter 'f' represents the redirected reverse flow exiting outlet on starboard side of deflector nozzle 34. As illustrated, reverse flow from the starboard deflector nozzle 34 is redirected laterally (represented by 'f'). However, in combination with the reverse flow directed through reverse nozzle outlet channel, the redirection provides an efficient and functional lateral thrust capable of acting on the watercraft while in reverse. The redirected reverse flow 'f' is angularly displaced from the center plane 26 of watercraft 30 by approximately 135 degrees. The reader will appreciate that the angular displacement does not have to be 135 degrees. Instead the angular displacement could be adjustable and/or at least greater than 90 degrees from center plane 26 of watercraft. The combination of reverse flow exiting reverse nozzle outlet channel and reverse flow exiting outlet of present device creates an overall lateral thrust of approximately 90 degrees from center plane 26 (see small graphical representation in FIG. 17A—vector R). The angle of displacement from the center plane 26 is shown by the angular representations (here two curved arcs). Where R represents the combination of reverse flow, the net force acting on the watercraft is directly opposite vector R. In other words, the net force on watercraft 30 created by flow R, pushes watercraft 30 in the opposite direction of arrow R.

On the other hand, FIG. 17C illustrates the jet stream redirection while in reverse, with deflector nozzle 34 rotated all the way toward the starboard side of watercraft 30. The deflector nozzle 34 is now directing flow into first nozzle outlet opening 42 and first inlet 14 of first main body 12 (FIG. 14). Again, the redirected reverse flow provides lateral thrust and is illustrated by the letter 'f' in FIG. 17C. The redirected reverse flow is angularly displaced from the center plane 26 of watercraft 30 by slightly greater than 135 degrees. Again, only one-half of the total reverse flow from deflector nozzles 34 is redirected laterally through the device in the illustrated position. The combination of reverse flow through reverse nozzle outlet exit and reverse flow through outlet of present device creates an overall lateral thrust of over 90 degrees from center plane 26 (see small graphical representation in FIG. 17C).

FIG. 17B illustrates the deflector nozzle 34, with no rotation (straight on). In this position the present device has no impact over the prior art. Little to no reverse flow is directed through first or second inlet 14, 15 (also shown and described in FIG. 13). Therefore, the net force on the watercraft 30 is opposite vector R (directly rearward), slowing, stopping or pushing boat in a rearward direction.

The reader will appreciate that as the deflector nozzle 34 rotates toward or away from the port or starboard side of watercraft 30, first or second inlet 14, 15, respectively, accepts more or less of reverse flow. Therefore, as an example, as the deflector nozzle 34 rotates toward the port side of the watercraft 30, second inlet 15 accepts, at first, a very small percentage of the jet stream. The lateral thrust therefore slowly increases creating a smooth transition to a greater amount of directional control while in reverse. As more jet stream is redirected, causing greater lateral thrust, the user can slowly increase the angular net force on the watercraft 30 when in reverse. This allows for the net force on watercraft 30 (opposite R) to shift in relation to centerline of boat (where vector R shifts from 0 degrees— FIG. 17B to approximately 90 degrees—FIG. 17A or 17C). This allows the driver to control the amount of lateral thrust by rotating the steering wheel.

The preceding description contains significant detail regarding the novel aspects of the present invention. It should not be construed, however, as limiting the scope of the invention but rather as providing illustrations of the preferred embodiments of the invention. As an example, device 10 can be fully integrated with deflector nozzle 34. Additionally, device 10 and channels 16, 17 can be any shape such that redirection of reverse flow occurs as is described. Thus, the scope of the invention should be fixed by the claims, rather than by the examples given.

Having described my invention, I claim:

1. A device for redirecting a reverse jet stream flow created by a watercraft having a center plane, having a pump assembly, wherein said pump assembly has an impeller duct, an impeller housing and a deflector nozzle, wherein said deflector nozzle has a nozzle outlet, reverse gate pivotably connected to said deflector nozzle, and a first and second reverse nozzle outlet, said device comprising:

a first main body having a first channel connected to said deflector nozzle proximate said first reverse nozzle outlet;

a second main body having a second channel connected to said defector nozzle proximate said second reverse nozzle outlet;

wherein said first channel fluidly connects a first inlet having a cross-section to a first outlet having a cross-section;

wherein said first channel curves such that said cross-section of said first inlet is approximately perpendicular to said cross-section of said first outlet;

wherein said second channel fluidly connects a second inlet having a cross-section to a second outlet having a cross-section; and wherein said second channel curves such that said cross-section of said second inlet is approximately perpendicular to said cross-section of said second outlet.

2. The device as recited in claim 1, wherein said first main body and said second main body each have a front wall, a side wall, a bearing wall and a rear wall.

3. The device as recited in claim 2, further comprising an attachment point on said front wall of said first main body and said second main body.

4. The device as recited in claim 3, wherein said first main body is attached to said deflector nozzle within said first reverse nozzle outlet.

5. The device as recited in claim 4, wherein said second main body is attached to said deflector nozzle within said second reverse nozzle outlet.

6. The device as recited in claim 5, wherein said first inlet on said first inlet obstructs slightly less than 50% of said first reverse nozzle outlet opening.

7. The device as recited in claim 6, wherein said second inlet on said first main body obstructs slightly less than 50% of said second reverse nozzle outlet opening.

8. A device for redirecting a reverse jet stream flow created by a watercraft having a starboard side and a port side, wherein said watercraft has a center plane and a pump assembly, wherein said pump assembly has an impeller duct, an impeller housing and a deflector nozzle, wherein said deflector nozzle has a nozzle outlet, reverse gate pivotably connected to said deflector nozzle, a first and second reverse nozzle outlet channel and a first and second reverse nozzle outlet opening, said device comprising:

a first main body defining a first channel within said first reverse nozzle outlet channel;

wherein said first channel fluidly connects a first inlet to a first outlet;

wherein said first channel is configured to redirect said reverse jet stream flow when said deflector nozzle is rotated such that said reverse jet stream flow is primarily directed through first reverse nozzle outlet opening and first inlet;

wherein said reverse jet stream flow into said first reverse nozzle outlet opening and said first inlet is in a downward and backward direction with respect to said watercraft;

wherein said first channel bends said reverse jet stream flow such that when said reverse jet stream flow exits said first outlet said reverse jet stream flow is primarily a lateral flow with respect to said deflector nozzle;

a second main body defining a second channel within said second reverse nozzle outlet channel;

wherein said second channel fluidly connects a second inlet to a second outlet;

wherein said second channel is configured to redirect said reverse jet stream flow when said deflector nozzle is rotated such that said reverse jet stream flow is primarily directed through second reverse nozzle outlet opening and second inlet;

wherein said reverse jet stream flow into said second reverse nozzle outlet channel and said second inlet is in a downward and backward direction with respect to said watercraft, and wherein said first channel bends said reverse jet stream flow such that when said reverse jet stream flow exits said second outlet said reverse jet stream flow is primarily a lateral flow with respect to said deflector nozzle.

9. The device as recited in claim 8, wherein when said deflector nozzle is square to said watercraft, said reverse jet stream flow is primarily directed through said first reverse nozzle outlet channel and said second reverse nozzle outlet channel.

10. The device as recited in claim 8, wherein when said deflector nozzle is fully rotated toward said starboard side of said watercraft, said reverse jet stream flow is primarily directed through said first reverse nozzle outlet opening and said first inlet.

11. The device as recited in claim 10, wherein said first channel redirects approximately 45 to 50% of said reverse jet stream flow such that said reverse jet stream flow that exits said first outlet of said first main body is primarily lateral with respect to said deflector nozzle.

12. The device as recited in claim 8, wherein when said deflector nozzle is fully rotated toward said port side of said watercraft, said reverse jet stream flow is primarily directed through said second reverse nozzle outlet opening and said second inlet.

13. The device as recited in claim 12, wherein said second channel redirects approximately 45 to 50% of said reverse jet stream flow such that said reverse jet stream flow that exits said second outlet of said second main body is primarily lateral with respect to said deflector nozzle.

14. A device for redirecting a reverse jet stream flow created by a watercraft having a starboard side and a port side, wherein said watercraft has a center plane and a pump assembly, wherein said pump assembly has an impeller duct, an impeller housing and a deflector nozzle, wherein said deflector nozzle has a nozzle outlet, reverse gate pivotably connected to said deflector nozzle, a first and second reverse nozzle outlet opening and a first and second reverse nozzle outlet channel, said device comprising:

a first main body defining a first channel within said first reverse nozzle outlet channel such that said first reverse nozzle outlet opening is narrowed by approximately 50%;

wherein said first channel fluidly connects a first inlet to a first outlet;

wherein said first channel is configured to redirect said reverse jet stream flow when said deflector nozzle is rotated such that said reverse jet stream flow is primarily directed through said first reverse nozzle outlet opening and first inlet;

wherein said reverse jet stream flow into said first reverse nozzle outlet opening and said first inlet is in a downward and backward direction with respect to said watercraft;

wherein said first channel bends said reverse jet stream flow such that when said reverse jet stream flow exits said first outlet said reverse jet stream flow is angularly displaced by at least greater than 90 degrees from said center plane of said watercraft;

a second main body defining a second channel within said second reverse nozzle outlet channel such that said second reverse nozzle outlet opening is narrowed by approximately 50%;

wherein said second channel fluidly connects a second inlet to a second outlet;

wherein said second channel is configured to redirect said reverse jet stream flow when said deflector nozzle is rotated such that said reverse jet stream flow is primarily directed through second reverse nozzle outlet opening and second inlet;

wherein said reverse jet stream flow into said second reverse nozzle outlet opening and said second inlet is in a downward and backward direction with respect to said watercraft; and wherein said second channel bends said reverse jet stream flow such that when said reverse jet stream flow exits said second outlet said reverse jet stream flow is angularly displaced by at least greater than 90 degrees from said center plane of said watercraft.

15. The device as recited in claim 14, wherein said first main body and said second main body each have a front wall, a side wall, a bearing wall and a rear wall; and wherein said first main body and said second main body are attached to said deflector nozzle within said first reverse nozzle channel and said second reverse nozzle channel respectively.

16. The device as recited in claim 14, wherein as said deflector nozzle pivots toward said port side of said watercraft, said second inlet is configured to accept an increasing volume of said reverse jet stream flow.

17. The device as recited in claim 14, wherein as said deflector nozzle pivots toward said starboard side of said watercraft, said first inlet is configured to accept an increasing volume of said reverse jet stream flow.

18. The device as recited in claim 14, wherein when said deflector nozzle is square to said watercraft, said reverse jet stream flow is primarily directed through said first reverse nozzle outlet channel and said second reverse nozzle outlet channel.

19. The device as recited in claim 14, wherein when said deflector nozzle is rotated fully toward said port side of said watercraft said reverse jet stream flow exiting said first reverse nozzle outlet channel and said reverse jet stream flow exiting said first outlet combine to create a force on said watercraft that is approximately 90 degrees from said center plane.

20. The device as recited in claim 14, wherein when said deflector nozzle is rotated fully toward said starboard side of said watercraft said reverse jet stream flow exiting said second reverse nozzle outlet channel and said reverse jet stream flow exiting said second outlet combine to create a force on said watercraft that is approximately 90 degrees from said center plane.

* * * * *